US007562547B2

(12) United States Patent
Avganim

(10) Patent No.: US 7,562,547 B2
(45) Date of Patent: Jul. 21, 2009

(54) COMPUTER ANTI-THEFT DEVICES

(76) Inventor: Mair Avganim, 156 Moshav Gealiya, M.P. Nachal Sorek 76885 (IL)

( * ) Notice: Subject to any disclaimer, the term of this patent is extended or adjusted under 35 U.S.C. 154(b) by 0 days.

(21) Appl. No.: 11/357,264

(22) Filed: Feb. 17, 2006

(65) Prior Publication Data

US 2007/0193314 A1 Aug. 23, 2007

(51) Int. Cl.
*E05B 69/00* (2006.01)

(52) U.S. Cl. ..... 70/58; 70/14; 70/30; 70/49

(58) Field of Classification Search ..... 70/14, 70/18, 58, 30, 49
See application file for complete search history.

(56) References Cited

U.S. PATENT DOCUMENTS 6,622,532 B2 * 9/2003 Hsu ..... 70/14
D490,434 S * 5/2004 Meyer et al. ..... D14/432
6,971,255 B2 * 12/2005 Bhogal et al. ..... 70/58
7,028,513 B2 * 4/2006 Avganim ..... 70/18
2007/0119219 A1 * 5/2007 DeMartinis et al. ..... 70/58

* cited by examiner

*Primary Examiner*—Suzanne D Barrett
(74) *Attorney, Agent, or Firm*—Blakely, Sokoloff, Taylor & Zafman LLP

(57) ABSTRACT

An anti-theft device for computers and the like having a housing with side-walls. The device comprises a block-shaped casing having a front surface, a lock member selectively projectable or withdrawable from the front surface and a key-operated lockable device effective to lock the lock member in the projected position thereof. At least a first hook-shaped projection is provided at the front surface located at one side of the projectable lock member. A cable is fixable to the casing at one end, and to an immovable object at the other end thereof. The first hook-shaped projection is adapted to be inserted into a first opening formed in a side-wall of the housing and then displaced so that the locking device becomes hooked to the housing, in which position the projectable lock member is inserted into an opening formed in the side-wall to prevent the separation of the first projection from the computer housing. A pair of hook shaped projections may be employed.

7 Claims, 9 Drawing Sheets

COMPUTER ANTI-THEFT DEVICES

FIELD OF THE INVENTION

The present invention relates to anti-theft devices, particularly for desk and portable computers.

BACKGROUND OF THE INVENTION

There has been developed a wide range of security devices to fight against computer thefts. For desk computers, it has been proposed to provide ways of securing the bottom of the computer housing to the working surface—see for example Applicant's U.S. Pat. No. 5,601,273 according to which the housing was arrested against the working surface by screws or strong glue intermediate a set of metal interlinking rails.

Portable computers are mostly protected by a steel cable connected to the computer housing, using an integrated dedicated slot or port therein formed by the manufacturer (see e.g. Applicant's U.S. Pat. No. 6,244,082).

All the prior art cable security devices have in common the use of a key operated lock casing provided with a projecting T-shaped tip or bit. The tip is insertable into the slot and turned by 90° (with the lock casing), so that the two arms of the "T" become placed behind the slot and prevent its retrieval. The lock is provided with a mechanism operative to insert into the slot, alongside the stem portion of the tip, an auxiliary pin which functions to block the rotation of the tip (and lock casing) into the initial insertion and retrieval position. The mechanism is operated by a key to lock or release the pin in and from its extended position, so that the lock casing can no longer be manipulated to rotate the tip.

One end of a steel cable is attached to the lock casing and the other to a stationary object such as around a table leg.

The various security devices offered to the public differ only in the auxiliary pin projecting and withdrawal methods, namely in the locking mechanism, which is the more costly part of the security devices of this type.

It is the prime object of the present invention to dispense altogether with the necessity to employ a pin feeding and/or locking/releasing mechanism of the conventional computer anti-theft devices.

It is a further object of the invention to employ more than one dedicated slots for the purpose in question.

SUMMARY OF THE INVENTION

According to the invention there is provided an anti-theft device for computers and the like having a housing with side-walls comprising a block-shaped casing having a front surface; a lock member selectively projectable or withdrawable from the front surface; a key-operated lockable device effective to lock the lock member in the projected position thereof; at least a first hook-shaped projection at the said surface located at one side of the projectable lock member; and a cable fixable to the casing at one end, and to an immovable object at the other end thereof, wherein the said first hook-shaped projection is adapted to be inserted into a first opening formed in a side-wall of the housing and then displaced so that the locking device becomes hooked to said housing, in which position the said projectable lock member is insertable into an opening formed in the side-wall to prevent the separation of the first projection from the said side-wall.

In a preferred embodiment of the invention there are provided a pair of hook-shaped projections adapted to be inserted into a corresponding pair of openings.

BRIEF DESCRIPTION OF THE DRAWINGS

These and additional constructional features and advantages of the invention will be more fully understood in the light of the ensuing description of several preferred embodiments thereof, given by way of example only, with reference to the accompanying drawings wherein:—

DETAILED DESCRIPTION OF THE PREFERRED EMBODIMENTS

Figure 1:
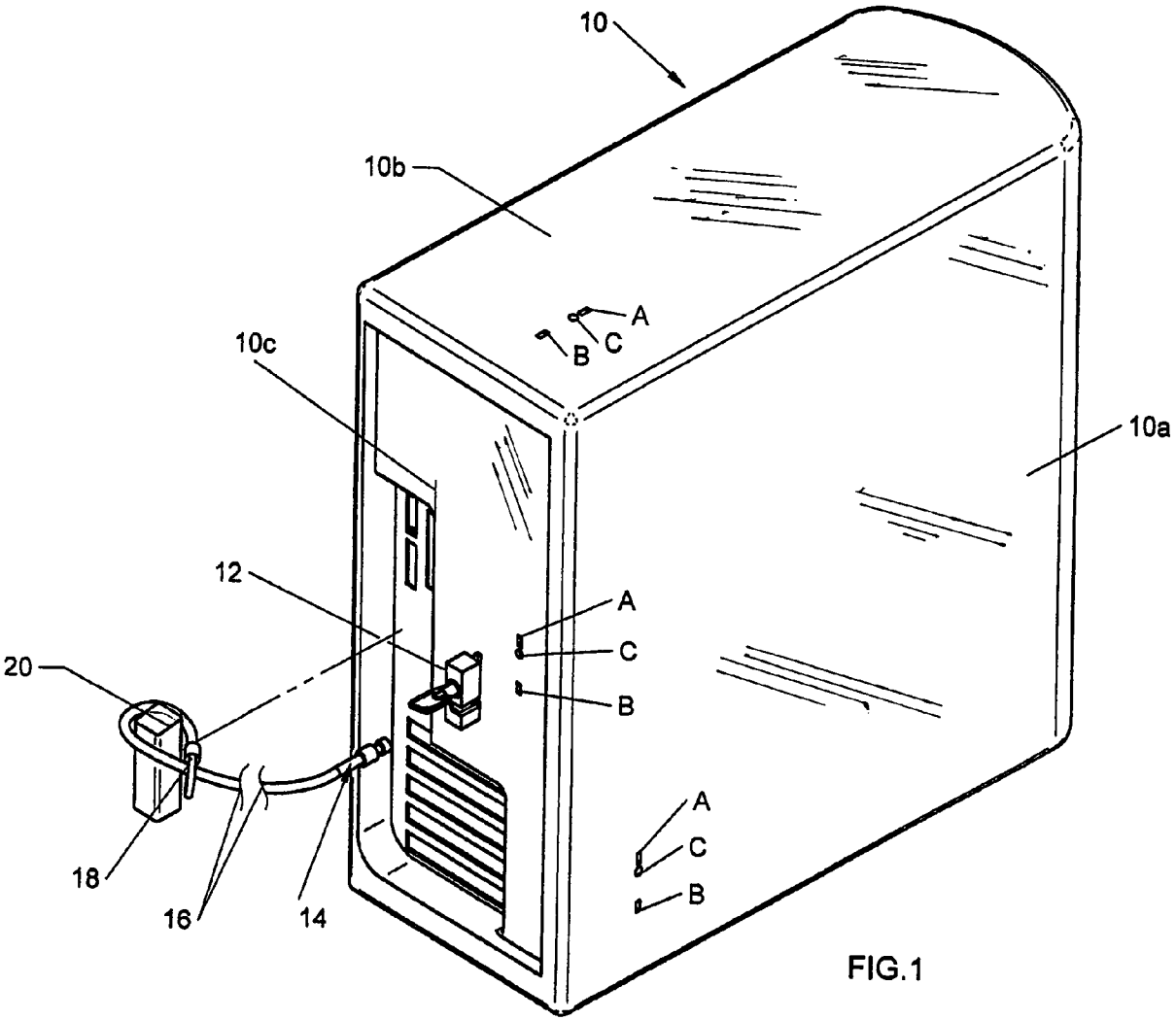
FIG. 1 is a general, schematic, three-dimensional view of a locking system according to a first preferred embodiment of the present invention as applied to a desk-computer.

As seen in FIG. 1, a desk computer generally denoted 10 has side walls 10*a*, a top wall 10*b* and a back wall 10*c*.

All walls are shown being formed with two distanced rectangular slots or ports A and B, and a circular hole C. In practice, though, one set of those three openings will suffice as will be understood in view of the description to follow. Anyway, the discussion below will be related to the set of openings made in the back wall 10*c* but it applies equally to sets placed anywhere else.

FIG. 1 further shows a locking device 12 and a security cable assembly 14 with cable 16 carrying a loop 18 for tying the cable 16 around a stationary object such as table leg 20 in the known fashion.

Figure 4:
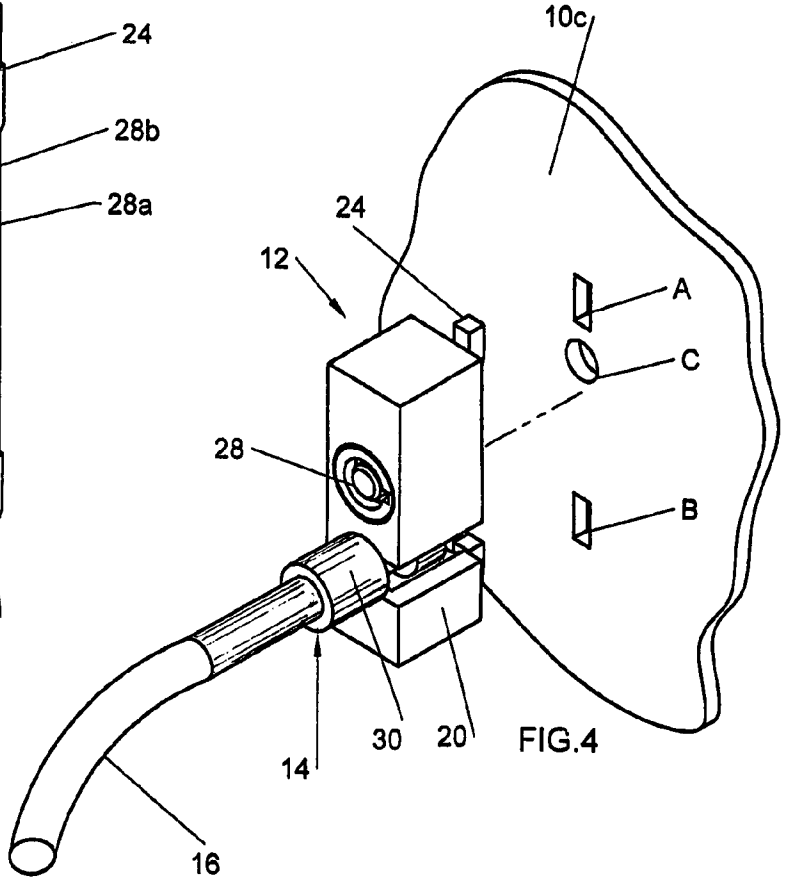
FIG. 4 is a more detailed view of the computer casing back wall and the lock-casing about to be secured thereto.
Figure 2:
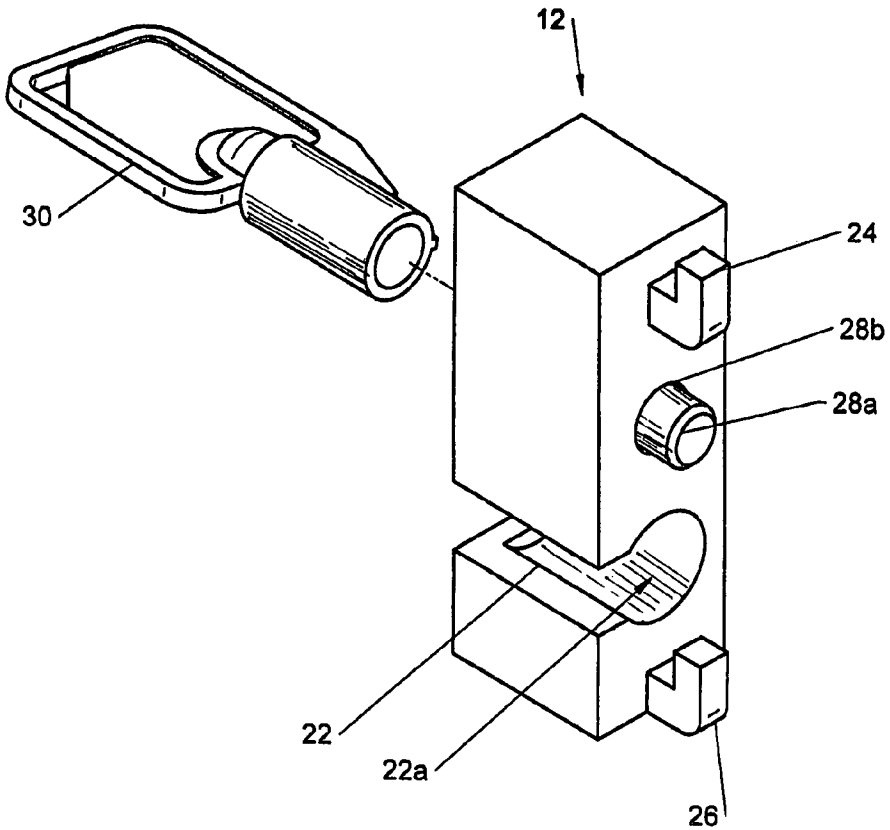
FIG. 2 is a front, three-dimensional view of the lock casing shown in FIG. 1.
Figure 3:
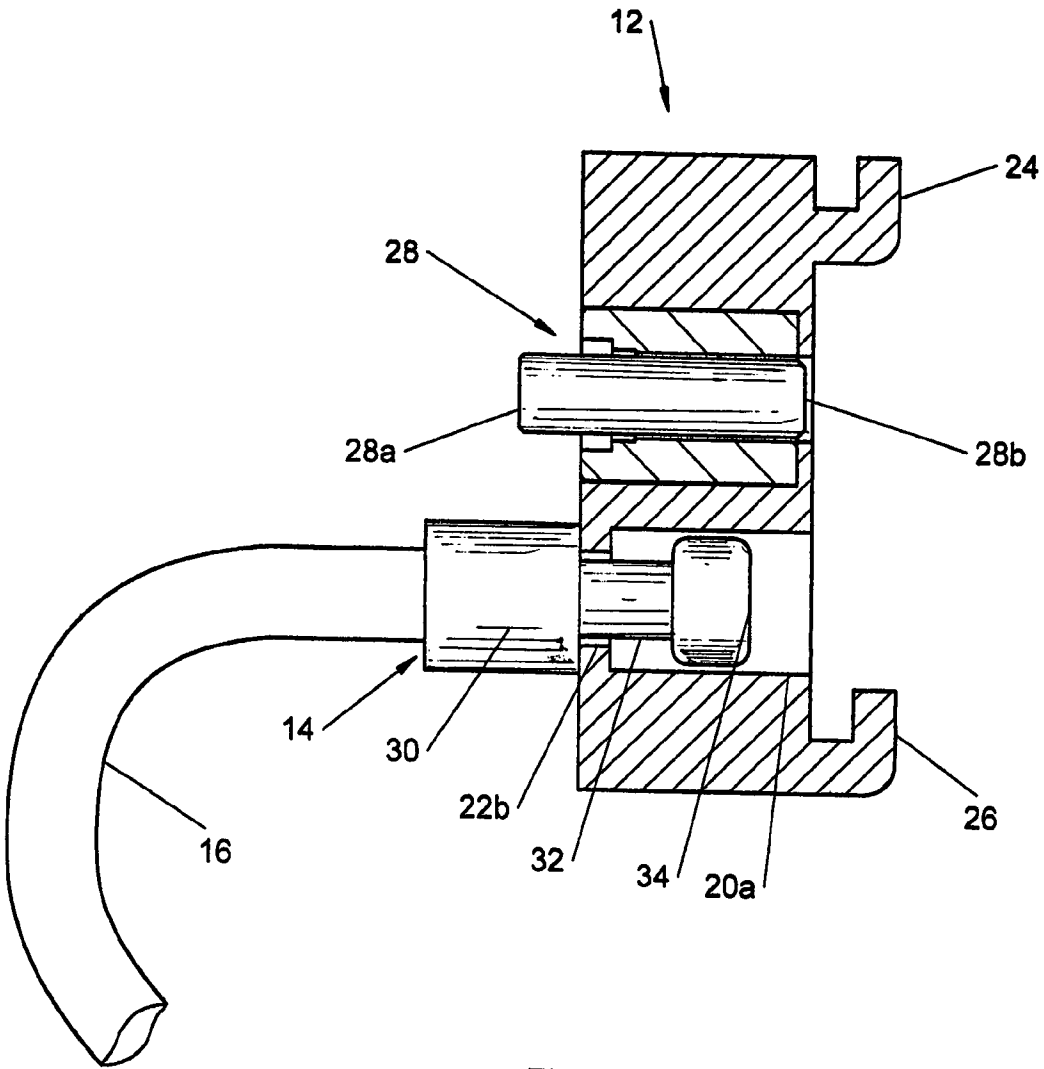
FIG. 3 is cross-sectional view of the lock casing shown in FIG. 2.

As more clearly seen in FIGS. 2-4, the locking device 12 has a lock body or casing made of cast metal, preferably but by no means essentially, formed with a recess 20 with an inner widened partially circular portion 22*a* extending from the front side thereof all the way rearwardly where it ends with a restricted collar 22*b*.

The lock device further comprises at-least one (see FIG. 8) but preferably a pair of hook-like, L-shaped projections 24 and 26. A conventional push-button type lock 28 is installed as shown, having a reciprocally, key-releasable lock-pin 28*a*. In the locking position of the device 12, the lock-pin 28*a* is adapted to project from bore 28*b*. Key 30 is used to release the lock-pin 28*a* from the pushed, locking position thereof.

The sizes of and the distance between the slots A and B are made such that both hooks 24 and 26 can be freely inserted therethrough; the size and the location of the hole C are designed so that the lock pin 28*a* can pass therethrough after the insertion of the hooks 24,26 through the slots A and B and movement of the lock casing upwards (in this example) as will be explained below.

While the security cable assembly 14 can be made integral with the casing of the lock casing 12, it is preferably separable. The cable 16 carries a cable-head 30 extended by a neck portion 32 of a reduced diameter (slightly less than the opening of the recess 22), and terminates by a rounded portion 34 of an increase diameter slightly less than the circular portion 22*a*. In this manner it is more convenient to threaded the cable head through the loop 18 before securing the lock casing to the computer wall.

The operation of the locking device is as depicted in FIGS. 5*a*-5*d*. At first, the cable head 30 is connected to the lock casing 12 by inserting the neck portion 32 along the slot 20. Then, the casing 12 is brought to the computer wall so that the hook 24 is in register with the slot A and the hook 26 is in register with the slot B. Once inserted (FIG. 5*b*), a short upwards shifting of the lock casing will bring the lock casing into the position of FIG. 5*c*. The location of the hole C is so designed that it is now in exact alignment with the lock pin 28*a* of the push-button lock 28.

Figure 5A:
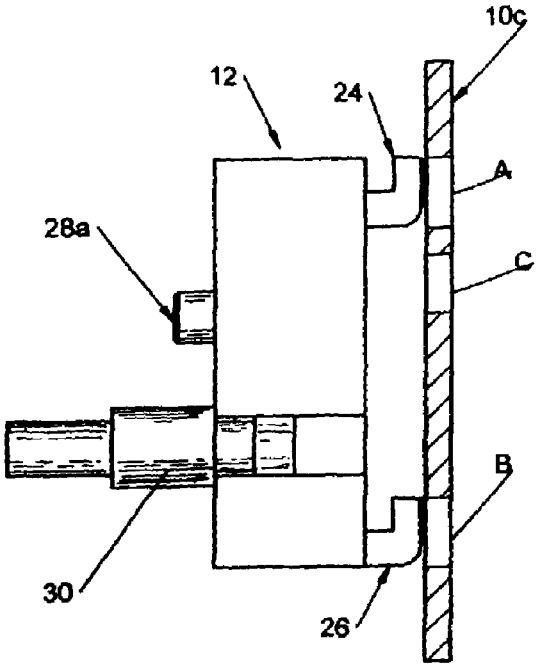
FIGS. 5*a* to 5*d* show the succession of operations performed to secure the lock-casing to the computer casing.
Figure 5B:
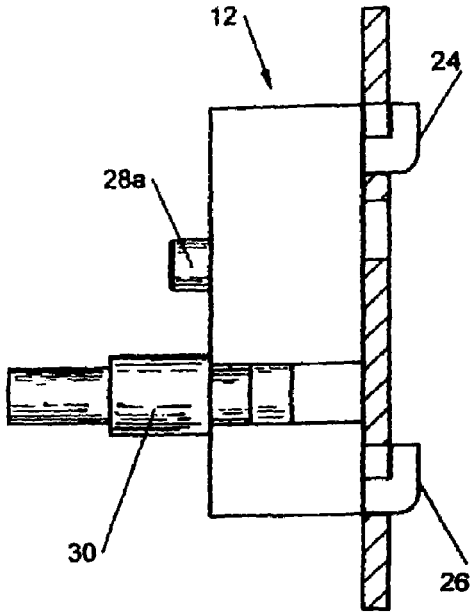
Figure 5C:
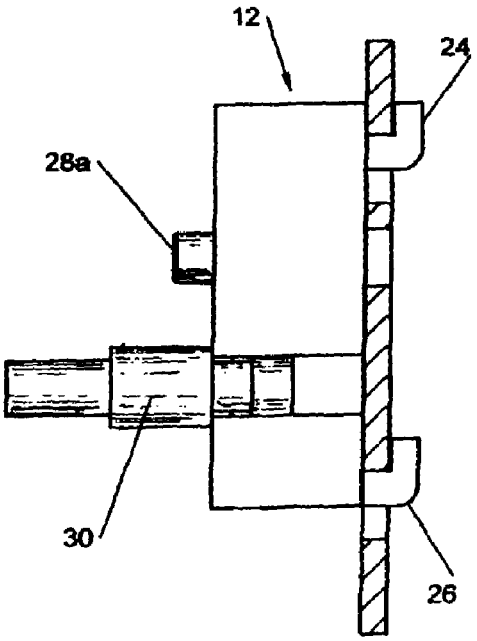
Figure 5D:
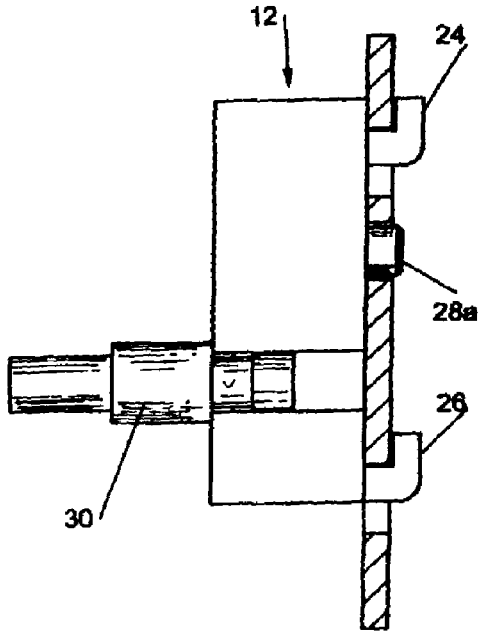

Pushing the lock pin 28*a* home prefects the arresting of the lock casing against the computer wall as shown in FIG. 5*d*.

For unlocking, the key 30 is used in the conventional manner, the lock pin 28 resumes the retracted position thereof allowing the lock casing to be lowered so that the hooks 24 and 26 can be retrieved.

It will be readily understood that the lock 12 can be equally secured to other of the walls of the desk computer (10*a* or 10*b*) as convenient to the user.

Figure 6A:
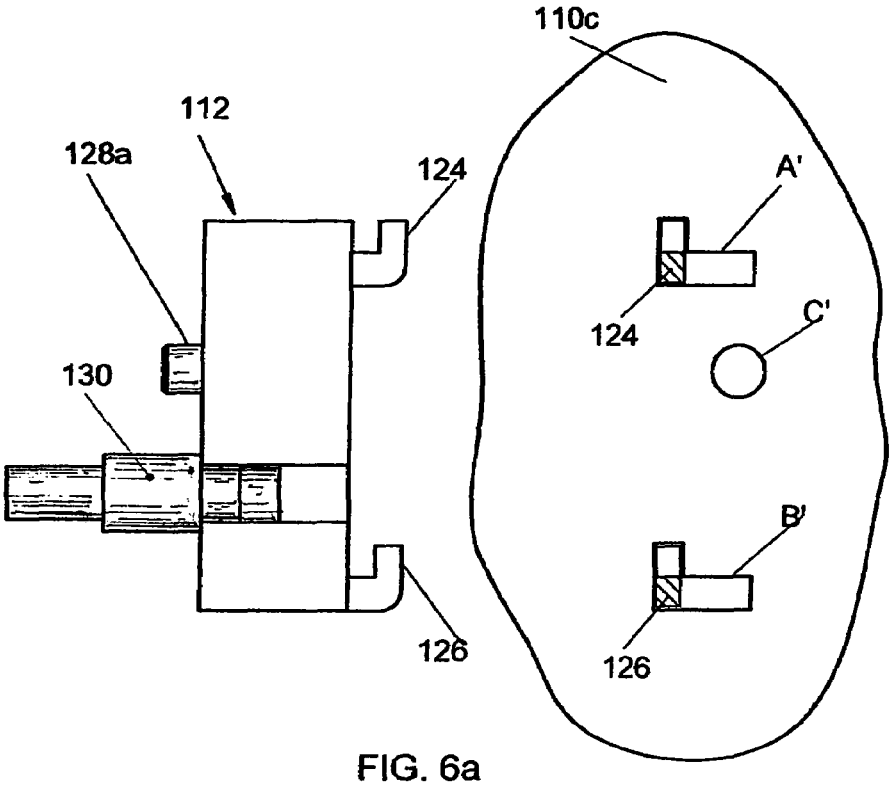
FIGS. 6*a* and 6*b* illustrate a modified form of the hooks receiving slots.
Figure 6B:
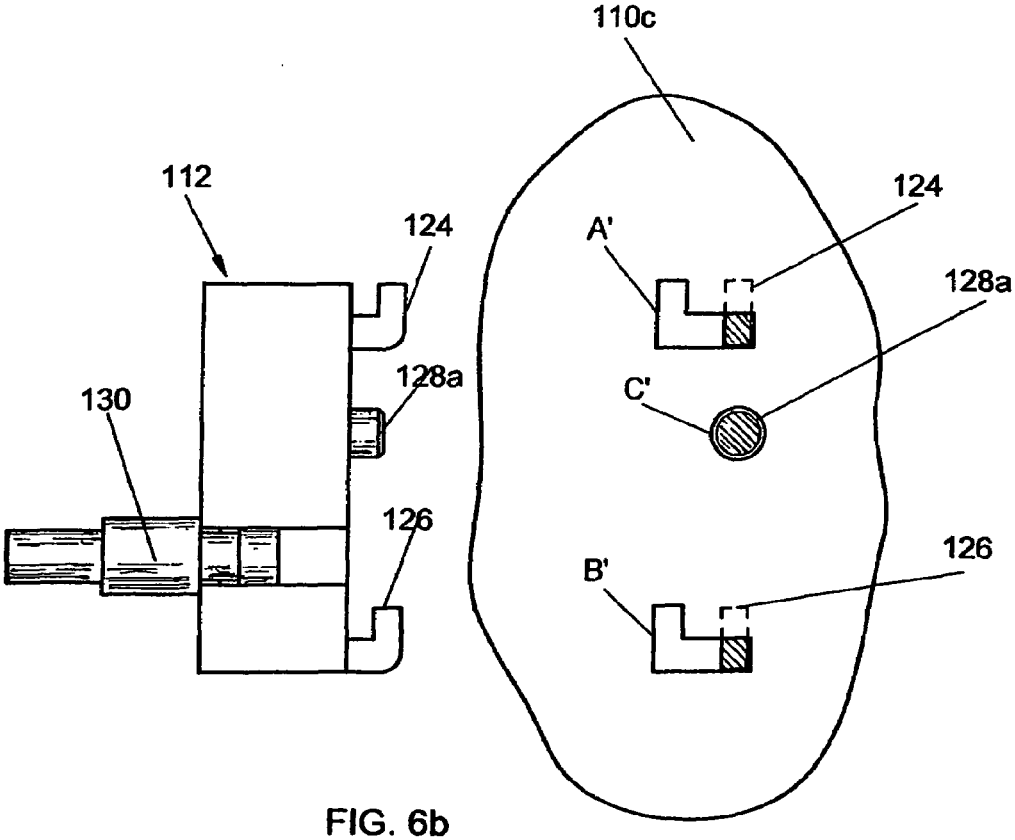

FIGS. 6*a* and 6*b* exemplify a modified configuration of the slots A', B' and C'. The locking and unlocking procedure remain substantially the same. Hence, the slots A' and B' are L-shaped so that after passing the hooks 124 and 126 through the vertical portion of the slots, the lock casing 112 is moved to the right where the lock pin 128*a* is insertable into the hole C' as seen in FIG. 6*f*.

Figure 7A:
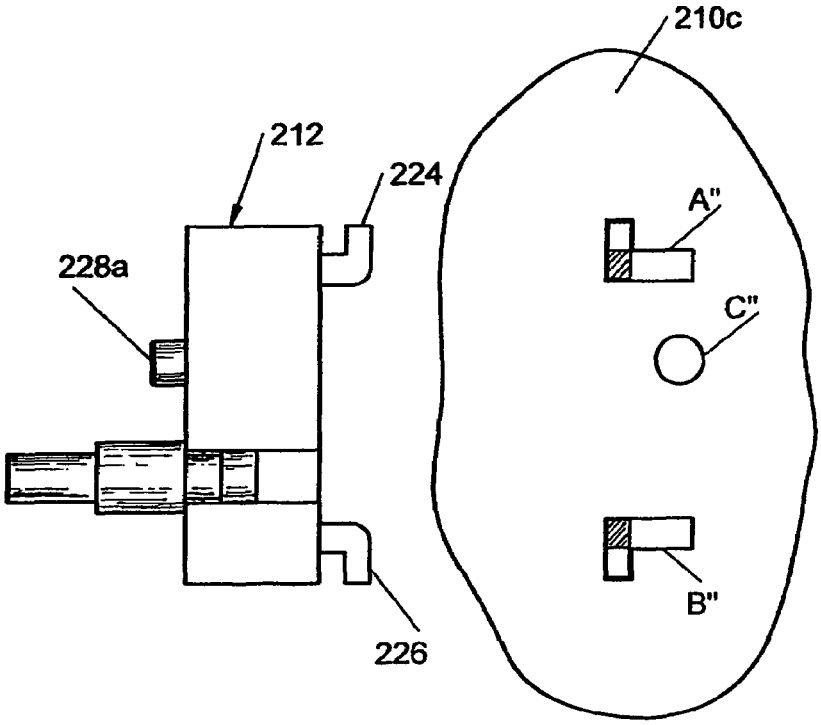
FIGS. 7*a* and 7*b* show a variation of the slots configuration.
Figure 7B:
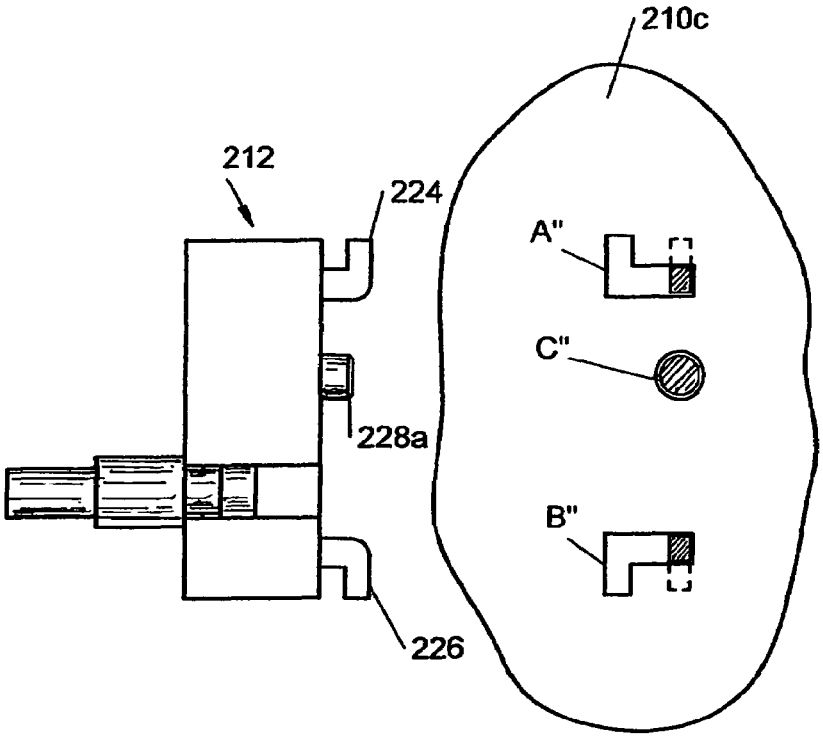

The configuration depicted in FIGS. 7*a* and 7*b* is similar. The hooks 224 and 226 point in opposite directions, and so are the L-shaped slots A" and B". As in the preceding embodiment, the hooks are inserted into the vertical legs of the slots and then moved to the side where the lock pin 228*a* becomes aligned with the hole C".

Figure 8A:
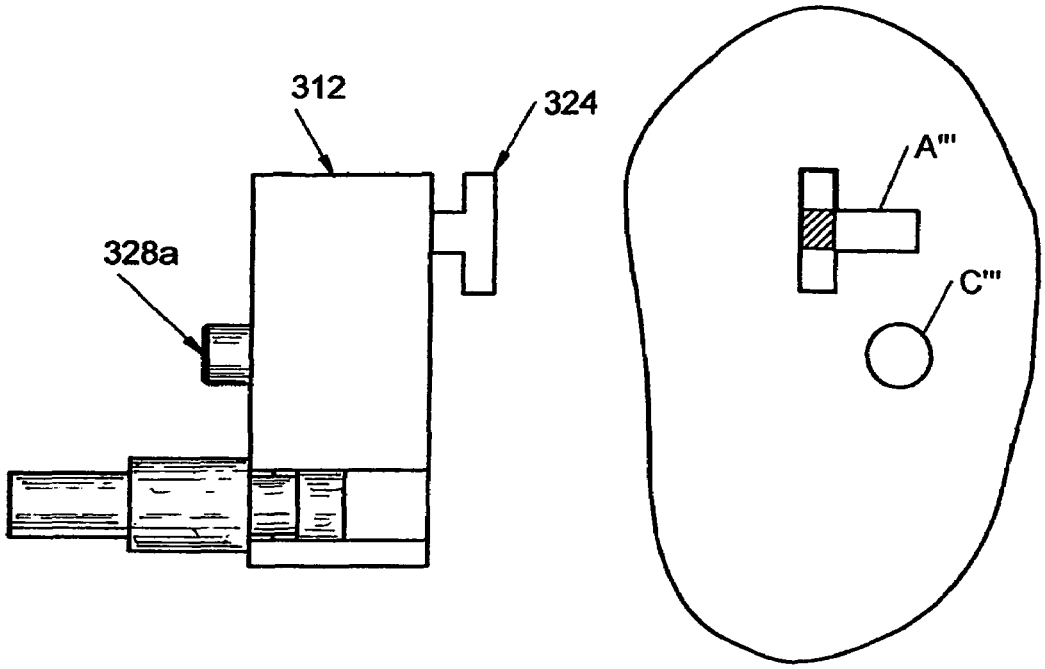
FIGS. 8*a* and 8*b* show the use of a single hook projection.
Figure 8B:
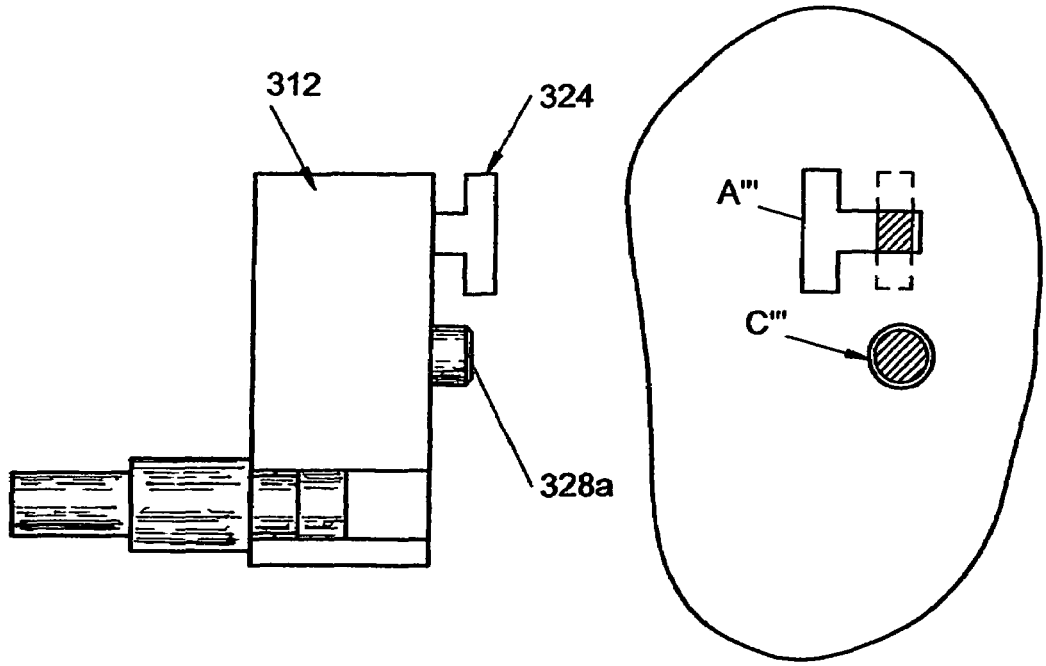

The embodiment of FIGS. 8*a*-8*b* illustrates the employment of a single hook projection 324, which is preferably T-shaped. The slot A"' is also T-shaped. The locking and unlocking operations remain the same as in the preceding embodiments.

Various other configurations can be contemplated, including the application of arcuate slots based on that the hole C is not at the center but closer to one of the slots A or B so that rotation of the lock casing back after the locking operation is blocked.

An important application of the present invention is the protection of portable computers.

Figure 9B:
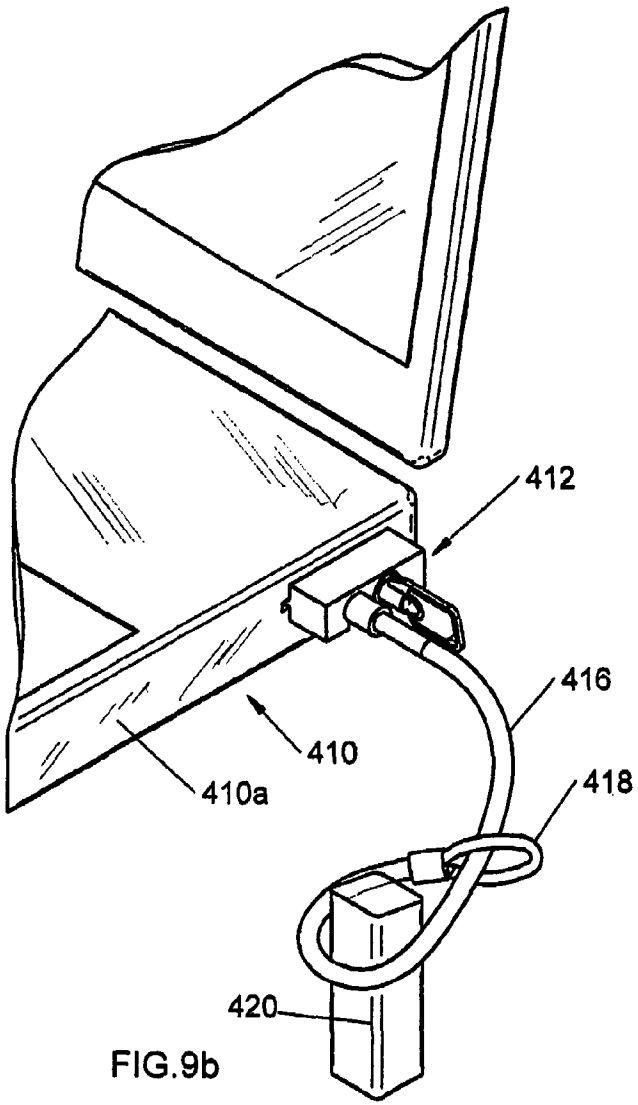
FIGS. 9*a* and 9*b* relate to the application of the invention to a portable computer.
Figure 9A:
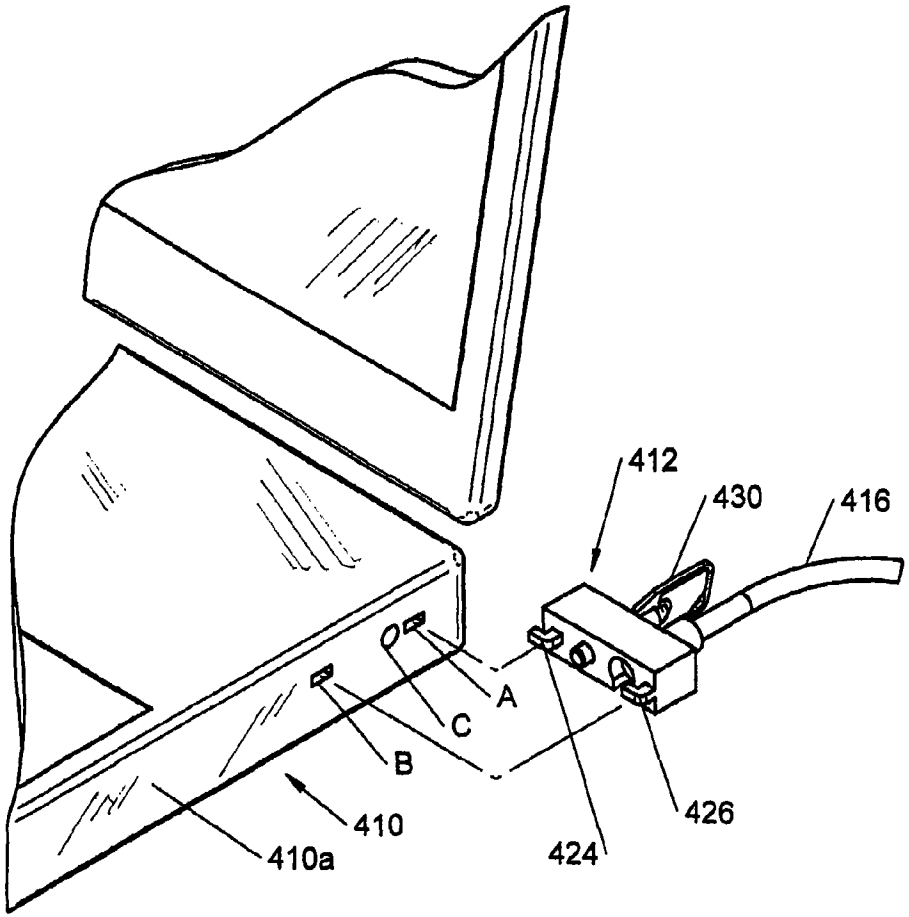

Referring to FIGS. 9*a* and 9*b*, shown is a portable computer 410 having a side-wall 410*a* formed with the set of openings A, B and C. The lock 412 is attachable to the computer wall 410*a* and tied to a fixed object 420 in the same manner described above (FIGS. 1-5) as clearly shown in FIG. 9*b*.

Figure 10:
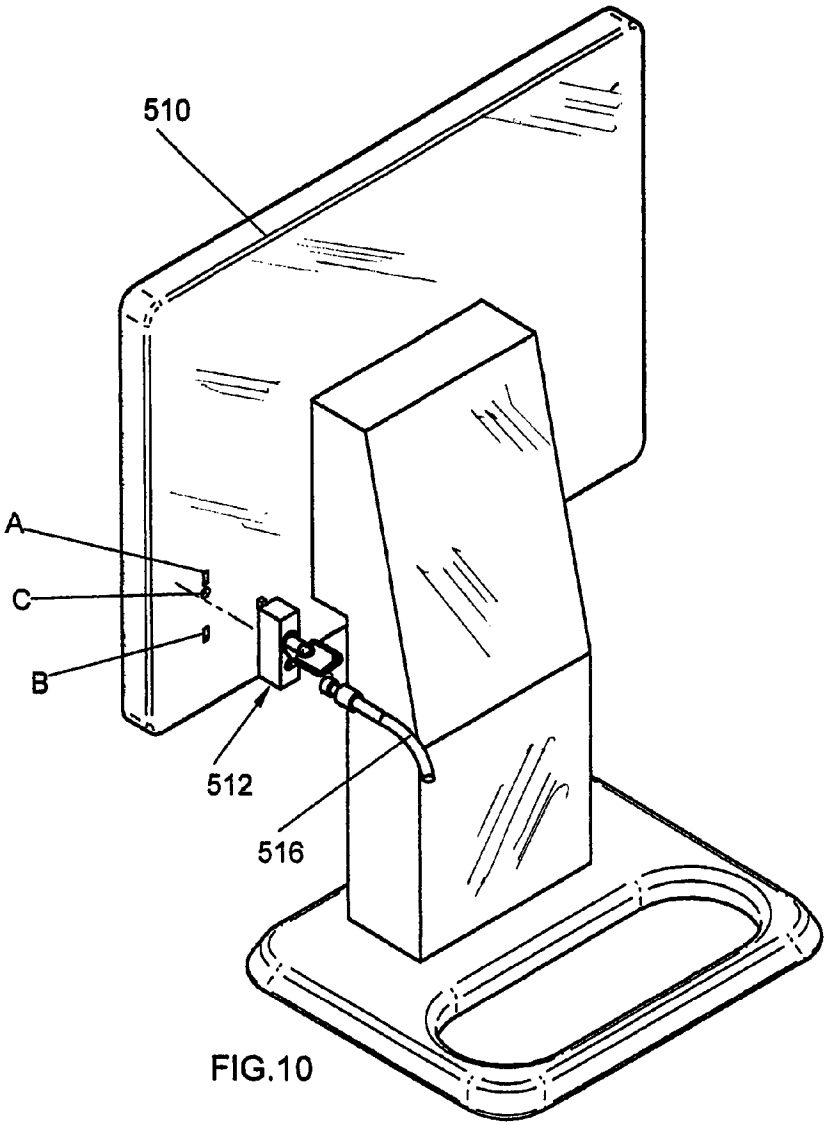
FIG. 10 exemplify the application of the invention to a flat computer display monitor.

The locking arrangement herein proposed is useful for protecting other articles, for example monitors 510 as shown in FIG. 10 which need not to be explained in greater detail.

Those skilled in the art to which this invention pertains will readily appreciate that numerous changes, variations and modifications can be effectuated without departing from the true spirit and scope of the invention as defined in and by the appended claims.

What is claimed is:

1. An anti-theft device for computers and the like having a housing with side-walls comprising:

a block-shaped casing having a front surface;

a lock member selectively projectable and withdrawable from the front surface;

a key-operated lockable device effective to lock the lock member in the projected position thereof;

at least a first projection at the said surface located at one side of the projectable lock member; and a cable fixable to the casing at one end, and to an immovable object at the other end thereof, wherein said first projection is adapted to be inserted into a first opening formed in a side-wall of the housing and then displaced so that the locking device becomes hooked to said housing, in which position said projectable lock member is insertable into an opening formed in the side-wall to prevent the separation of the first projection from said side-wall, a second projection, the first and second projections being adapted to be simultaneously inserted into first and second openings formed in a side-wall of the housing and then displaced so that the locking device becomes hooked to said housing, in which position said projectable lock member is insertable into a third opening formed in the side-wall to prevent the separation of the projections from said side-wall.

2. The device as claimed in claim 1 wherein the first projection is L-shaped and the first opening is a rectangular slot.

3. The device as claimed in claim 1 wherein the first opening is a T-shaped slot.

4. The device as claimed in claim 1 wherein the first and second projections are pointed in the same direction.

5. The device as claimed in claim 1 wherein the first and second projections are pointed in opposite directions.

6. The device as claimed in claim 1 wherein the key-operated lockable device is of the push-button type.

7. The device as claimed in claim 1 wherein the said one end of the cable comprises a head, and the block-shaped casing comprises a cavity open at said front surface and closed at the opposite side thereof and a slot extending therealong, said head being adapted to be coupled to the casing by inserting the cable head into the cavity.

* * * * *